United States Patent [19]

Thompson et al.

[11] 4,192,737

[45] Mar. 11, 1980

[54] FROTH FLOTATION OF INSOLUBLE SLIMES FROM SYLVINITE ORES

[75] Inventors: Philip Thompson, Salt Lake City; Jerry L. Huiatt, Murray; Don C. Seidel, Salt Lake City, all of Utah

[73] Assignee: The United States of America as represented by the Secretary of the Interior, Washington, D.C.

[21] Appl. No.: 942,833

[22] Filed: Sep. 15, 1978

[51] Int. Cl.[2] ..... B03D 1/02

[52] U.S. Cl. ..... 209/5; 209/166

[58] Field of Search ..... 209/166, 5; 252/61

[56] References Cited

U.S. PATENT DOCUMENTS

| | | | |
|---|---|---|---|
| 2,182,845 | 12/1939 | Morris | 209/166 |
| 2,222,330 | 11/1940 | Weinig | 209/166 |
| 2,275,138 | 3/1942 | Fuchs | 209/166 |
| 2,509,672 | 10/1951 | Jackson | 209/166 |
| 2,921,678 | 1/1960 | Fuchsman | 209/166 |
| 2,923,408 | 2/1960 | Williams | 209/166 |
| 3,016,143 | 1/1962 | Trachta | 209/166 |
| 3,452,667 | 7/1969 | Bishop | 209/166 |

FOREIGN PATENT DOCUMENTS

| | | | |
|---|---|---|---|
| 144145 | 11/1951 | Australia | 209/166 |
| 889132 | 9/1953 | Fed. Rep. of Germany | 209/166 |

*Primary Examiner*—Robert Halper

*Attorney, Agent, or Firm*—William S. Brown; Donald A. Gardiner

[57] ABSTRACT

Sylvinite ores are treated for removal of insoluble slimes by a froth flotation technique which includes flocculating the slimes with nonionic or polyacrylamide flocculants and thereafter utilizing a nonionic or an anionic flotation collector including a mixture of fuel oil or a fatty acid and a defoamer of the glycol ester or polyglycol ester type. The flocculated slimes may also be floated with a fatty acid collector alone at low pH conditions.

5 Claims, 4 Drawing Figures

FROTH FLOTATION OF INSOLUBLE SLIMES FROM SYLVINITE ORES

BACKGROUND OF THE INVENTION

1. Field of the Invention

This invention relates to the beneficiation of potash ores and, more particularly, relates to the removal of insoluble slimes from sylvinite ores through an improved froth flotation technique wherein specific collector reagents are utilized to both effect the flotation of the slimes and render residual insoluble slimes inert during subsequent flotation to recover sylvite (KCl).

2. Description of the Prior Art

The recovery of sylvite from sylvinite ores is known to be most efficiently achieved through the technique of froth flotation. However, such ores normally include impurities in the form of insoluble slimes, such as clays, other silicates and the like. Commercial desliming of sylvinite ores is usually accomplished by some form of mechanical separation technique, such as hydroclassification apparatus, including cyclone separators. Typically, the sylvinite ore pulp is passed through the cyclone and the overflow, after thickening, is discarded. However, this method usually results in the removal of a substantial portion of the sylvite values in the ore along with the slimes. Accordingly, the sylvite lost in the desliming is not available for recovery in the subsequent sylvite flotation of the ore, thereby reducing the sylvite recovered in this latter step.

Large tonnages of high-grade, low-water-insoluble-content sylvinite ores have been processed in the Permian Basin region in Carlsbad, New Mexico during the past forty years. These deposits are being rapidly depleted, thereby leaving large reserves of lower grade ore. This lower grade sylvinite ore contains 1% to 8% water-insoluble slimes, commonly referred to as insol slimes. These insol slimes must be removed prior to potash or sylvinite flotation because of their high adsorptive capacity for amines utilized in conventional potash flotation. The insol slimes are conventionally removed by scrubbing the ore particles, followed by hydroclassification, as earlier described, to separate the slimes from the coarse sylvinite ore. Any residual insol slimes not removed by the desliming procedure are blinded with suitable reagents, such as guar gum or starch, to prevent interference in subsequent potash flotation. Potash losses in the deslime product and process brine requirements increase as the insol content increases.

Presently known mechanical desliming methods are inadequate for processing sylvinite ores containing greater than 4% insol slimes because of high $K_2O$ loss in the deslime product, excessive brine requirements, and depression of subsequent KCl flotation by residual insol slimes not removed in the deslime stage. Methods heretofore developed to remove insol slimes by froth flotation of the flocculated slimes have been unsatisfactory because the residual insol slimes not removed during flotation serve to depress the subsequent KCl flotation, even when excessive amounts of slime blinder are used.

Various collector reagents have been used for removal of insol slimes by selective froth flotation of such slimes from sylvinite ores, with all such processes requiring that the insol slimes be initially flocculated prior to the addition of the flotation collector reagent in order to reduce the effective surface area of the insol slimes and prevent high absorption of the reagent by the slimes.

Such reagent schemes include using an acrylamide polymer flocculant and a frother, such as cresylic acid or methylisobutyl carbinol (MIBC), to float insol slimes. Another such process utilizes a high molecular weight cationic polymer to selectively flocculate insol slimes, after which the flocculated slimes are floated using a long chain carboxylicamine reaction product. A further process is also known utilizing an oxidized mixture of white spirit and acidol, and oxyethylated synthetic fatty acids as flotation collectors for flocculated insol slimes. Still another technique involves the use of a polyacrylamide flocculant and a cationic surfactant that may be either a condensation product of ethylene oxide with various organic nitrogen containing compounds or a quaternary ammonium chloride compound having at least one long chain alkyl group containing 12 to 18 carbons or a long chain acyl (alkyl-CO) group.

However, none of the above described reagent schemes utilizing selective froth flotation for the removal of insol slimes from sylvinite ores deal with the effect of unremoved residual insol slimes on subsequent KCl flotation recovery.

It is therefore highly desirable that a method for removing insol slimes from sylvinite ores serves to reduce potash losses in the insol slimes product, lower the process brine requirements, and increase subsequent potash recovery after insol slimes removal.

SUMMARY OF THE INVENTION

It is an object of the invention to provide an improved process for effectively removing insoluble slimes from sylvinite ores.

It is another object of the invention to provide improved flotation reagents for use in selective flocculation-flotation techniques to remove insoluble slimes from sylvinite ores that are compatible with existing potash flotation processes.

It is yet another object of the invention to provide improved insoluble slimes flotation reagents which render residual insoluble slimes inert during subsequent KCl flotation.

It is a further object of the invention to provide an improved process for removing insoluble slimes from sylvinite ores through a froth flotation technique that enhances KCl recovery during subsequent flotation.

These and other objects are achieved through the practice of the invention wherein insoluble slimes are removed from sylvinite ores in a saturated brine pulp by froth flotation. The slimes are initially flocculated with a nonionic or a cationic polyacrylamide flocculant in order to prevent adsorption of flotation collector on the slimes. The flocculated slimes are subjected to froth flotation by utilizing a collector reagent which may include caprylic acid, or a defoamer of the glycol ester or polyglycol ester type mixed with caprylic acid, oleic acid or fuel oil, such as Diesel Oil No. 2. The use of these reagents serves to render inert any residual insoluble slimes not removed in the slimes flotation step when the deslimed pulp is subjected to subsequent KCl flotation.

DETAILED DESCRIPTION OF THE PREFERRED EMBODIMENTS

The experimental materials utilized in the practice of the present invention comprised a run-of-mill potash ore sample with a high water-insol content from the Carlsbad, New Mexico area. Chemical analysis indicated this ore to have the composition as indicated in Table 1 below.

Table 1

| Chemical Analysis, wt-pct | | | | | | | |
|---|---|---|---|---|---|---|---|
| $K_2O$ | Na | Mg | Ca | $SO_4$ | Cl | Water insol | Acid Insol |
| 12.7 | 26.5 | 1.4 | 0.3 | 2.4 | 53.5 | 5.0 | 3.0 |

Petrographic and x-ray diffraction analysis of the ore indicated that sylvite (KCl) and halite (NaCl) were the major minerals present. The sylvite contained minor amounts of included hematite, which gave this mineral a distinct red color. Minor amounts of polyhalite ($MgSO_4.K_2SO_4.2CaSO_4.2H_2O$), leonite ($MgSO_4.K_2SO_4.4H_2O$), and kanite ($KCl.MgSO_4.2.75H_2O$) were also present. The water-insoluble fraction of the ore contained abundant magnesite, chlorite and illite.

The ore sample was split into two equal parts for equilibrium process brine production and flotation experiments. Samples for flotation testing were prepared by stage-crushing the ore through ten mesh using a roll mill and then splitting the crushed ore into 1-kilogram charges. Stage-crushing was used to avoid producing excessive fines which reduces overall potash recovery. A screen analysis of the ore indicated that less than 16% of the final crushed weight was finer than 100 mesh.

Equilibrium brine was prepared by mixing 41 kilograms of ore with 57 liters of tap water and agitating for 24 hours. The slurry was allowed to settle for two or three days, and the clear brine was decanted for use in test work.

Potash flotation reagents used in the study are all commercially available and included Armeen T.D. neutralized with HCl (a primary aliphatic tallow amine chloride), Barretts 634 flotation oil emulsified in tap water, and MRL-201 guar gum insol slime blinder. The insol slimes flocculants included high and medium molecular weight cationic, anionic and nonionic flocculants, natural organic flocculants, and polyvalent inorganic cations. Insol slimes flotation collectors included a cationic surfactant comprising a mixture of octadcyl amine and octadcyl guanidine salts of octadcyl carbamic acid reacted with ethylene oxide, a nonionic flotation collector consisting of an emulsion of Diesel Oil No. 2 (ASTM No. 2 D.A.) and a glycol ester, and an anionic flotation collector emulsion of fatty acid (either oleic or caprylic) mixed with a glycol or polyglycol ester. These glycol esters are well known common ingredients in commercial defoamers. Hexanol frother was also used as needed in all tests. All reagent consumptions are expressed in grams of reagent per metric ton of ore and abbreviated as grams per ton.

Figure 1:
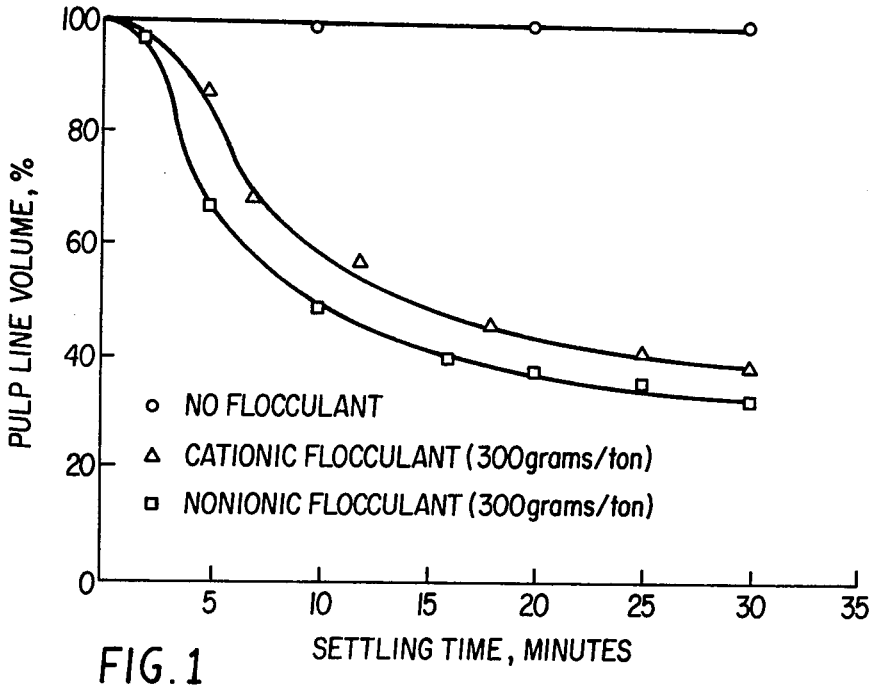
FIG. 1 is a graph depicting the settling time in minutes of water insoluble slimes as a function of pulp line volume in percent in conditions comprising the absence of a flocculant, the presence of a cationic flocculant, and the presence of a nonionic flocculant.

Settling tests were made to select the most effective flocculants for use in flotation testing. Flocculants listed included high molecular weight cationic, nonionic and anionic flocculants, medium molecular weight nonionic and anionic flocculants, natural organic flocculants such as starch, quebracho and guar gum, and polyvalent metal cations. The flocculants that gave the most rapid settling rates were a high molecular weight cationic acrylamide copolymer and a high molecular weight nonionic polyacrylamide. Settling curves for insol slimes using no flocculant, cationic acrylamide copolymer, and nonionic polyacrylamide are graphically represented in FIG. 1. The settling curves for all other reagents tested fell above the curves shown for these two flocculants. The slow settling characteristics were due to the high clay content of the insol slimes fraction of the ore. Based upon the results of these tests, the nonionic polyacrylamide and the cationic acrylamide copolymer were selected as flocculants in subsequent insol slimes flotation experiments for the invention.

Settling tests were performed in 200 milliliter graduated cylinders on the insol slimes fraction of each ore. The feed for the settling tests was prepared by diluting the insoluble material with saturated brine to 1.0% solids pulp density. The freshly prepared flocculants were mixed with the slurry for one minute, and the insoluble slimes were allowed to settle.

Top-loading filtration tests were performed on insol slimes flotation concentrates and nonfloated insol slimes products, using both a 0.02 square meter (0.3 square foot) Buchner funnel attached to a series of graduated cylinders and a standard 0.009 square meter (0.1 square foot) filter leaf with a 7.6 centimeter (3 inch) collar attached. All tests were made with 635 millimeters (25 inches) of mercury vacuum.

Mechanical sliming tests were conducted with 1 kilogram samples of ore scrubbed with saturated equilibrium brine at 27% solids pulp density for fifteen minutes in a Fagergren laboratory flotation cell, using a peripheral impeller speed of 4.22 meters per second (830 feet per minute). The slurry was allowed to settle for one minute, and the remaining suspended solids were decanted onto a vibrating 150 mesh screen. After the screen oversize was washed back into the deslimed sample, the decantation procedure was repeated. The final deslimed material was used as potash flotation feed.

Batch insol slimes flotation tests were conducted in the Fagergren laboratory flotation cell. In each test, 1 kilogram of ore was scrubbed five minutes at 27% solids pulp density in a saturated brine at 4.22 meters per second (830 feet per minute) peripheral impeller speed. Concentrated HCl was used for pH adjustment. Flocculant and collector were gently folded into the pulp with a spatula for a conditioning period of two minutes. The peripheral impeller speed was adjusted to 3.65 meters per second (720 feet per minute), air was introduced, and an insol slimes froth product was collected for two minutes. The conditioning and flotation procedures were repeated two or three times, depending on the insol content of the ore. Total insol flotation time ranged from six to ten minutes.

Testing indicated that the use of a nonionic flocculant-cationic surfactant collector reagent scheme for insol slimes flotation can cause problems in subsequent KCl flotation, because residual insol slimes, not removed by flotation, reduce subsequent potash flotation recovery even when a slime blinder is used to depress the insols. Consequently, alternative reagent schemes were investigated, with the reagents indicating the greatest effectiveness being combinations of a cationic flocculant and insol slimes collectors that included caprylic acid below a pH of about 4, caprylic acid plus glycol ester defoamers at a pH of approximately 2 to 8, oleic acid plus a polyglycol ester defoamer and natural pH of approximately 7.6, and Diesel Oil No. 2 plus ethyleneglycol monoacetate (a glycol ester) at natural pH.

EXAMPLE 1

Part A: One thousand grams of New Mexico sylvinite ore containing, in weight percent, 12.6 percent $K_2O$, 26.5 percent Na, and 5.0 percent water insolubles, were pulped to 27 percent solids with a saturated equilibrium brine in a Fagergren flotation cell. The pH of the pulp was 7.6. The pulp was scrubbed at 1,400 rpm (724 feet per minute peripheral impeller speed) for 5 minutes, after which time the impeller was turned off and 0.2 pound Betz 1160 cationic flocculant per ton of ore was folded gently into the pulp. After 15 seconds gentle stirring with a spatula 0.1 pound of caprylic acid per ton of ore was added to the pulp, which was stirred gently with a spatula for 2 minutes. One drop of frother was then added, the cell was turned on, the impeller speed was adjusted to 1,400 rpm, air was introduced, and a froth product was skimmed for a period of 4 minutes. The reagentizing, conditioning, and flotation steps were repeated twice, using identical reagent dosages as in the first step. Five minutes flotation time was used during the second flotation step and 1 minute flotation time was used during the third flotation step.

Part B: Part A was repeated, except that enough HCl was added dropwise prior to reagentizing to bring the pH down to 6.0 in each flotation step.

Part C: Part A was repeated except that enough HCl was added dropwise prior to reagentizing to bring the pH down to 4.0 in each flotation step.

Part D: Part A was repeated except that enough HCl was added dropwise prior to reagentizing to bring the pH down to 2.0 in each flotation step. The results of these tests are listed in Table 2 with all data corrected for brine entrainment.

Table 2

Insol slimes rougher flotation using Betz 1160 flocculant and caprylic acid at various pH values

| | | Assay, wt-pct | | Distribution, pct | |
|---|---|---|---|---|---|
| Part | Flotation pH | $K_2O$ | Water Insol | $K_2O$ | Water Insol |
| A | 7.6 | 5.2 | 33.2 | 4.3 | 54.4 |
| B | 6.0 | 7.4 | 33.1 | 5.6 | 52.8 |
| C | 4.0 | 9.9 | 27.6 | 9.5 | 72.6 |
| D | 2.0 | 7.8 | 33.3 | 7.3 | 77.3 |

EXAMPLE 2

Part A: One thousand grams of the same sylvinite ore was treated according to the procedure described in Example 1A, except that 0.1 pound of a commercial glycol ester defoamer per ton of ore was added dropwise with the caprylic acid in each reagentizing step. Note: A kerosene base is used in these defoamers. The third insol rougher flotation step required 2 minutes using this reagent scheme.

Part B: Part A was repeated, except that enough HCl was added dropwise to reduce the pulp pH to 6.0 during each flotation step.

Part C: Part A was repeated, except that enough HCl was added dropwise to reduce the pulp pH to 4.0 during each flotation step.

Part D: Part A was repeated, except that enough HCl was added dropwise to reduce the pulp pH to 2.0 during each flotation step. The results of these tests are listed in Table 3.

Table 3

Insol slimes rougher flotation using Betz 1160 flocculant, caprylic acid and a commercial glycol ester defoamer at various pH values

| | | Assay, wt-pct | | Distribution, pct | |
|---|---|---|---|---|---|
| Part | Flotation pH | $K_2O$ | Water Insol | $K_2O$ | Water Insol |
| A | 7.6 | 3.5 | 29.4 | 5.2 | 79.4 |
| B | 6.0 | 6.6 | 29.1 | 8.1 | 79.4 |
| C | 4.0 | 6.6 | 30.3 | 7.9 | 81.0 |
| D | 2.0 | 9.9 | 28.9 | 11.2 | 84.0 |

Figure 2:
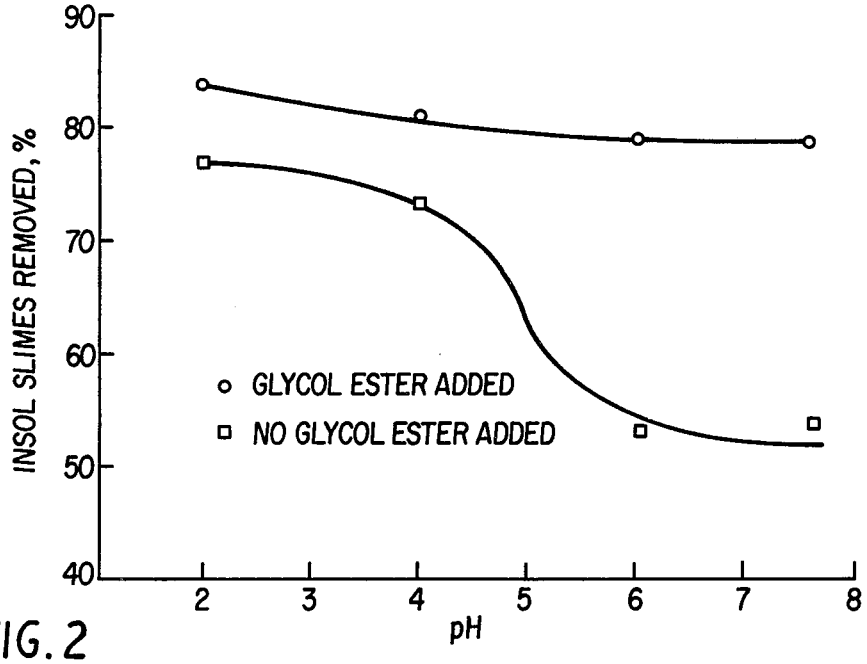
FIG. 2 is a graph representing the effect of pH on the removal of water insoluble slimes through flotation while utilizing a cationic flocculant with caprylic acid alone, and caprylic acid plus a glycol ester.

The data presented in Tables 2 and 3 are graphically represented in FIG. 2. Insol slimes flotation using caprylic acid alone was pH sensitive. As seen in FIG. 2, insol slimes flotation recovery decreased drastically from over 70% at pH 4.0 to less than 55% at pH 6.0. This phenomenon suggests that the free fatty acid was responsible for insol slimes flotation because as the pH was increased, insoluble magnesium and calcium fatty acid salts precipated, reducing the amount of free, available fatty acid in the system, and thus reducing insol slimes flotation recovery. When a glycol ester defoamer was added with the caprylic acid, the pH effect was not observed and insol slimes flotation recovery remain higher than 79%. The defoamer also aids in controlling the voluminous insol slimes concentrate froth. Additional experiments conducted are set forth in the following Examples.

EXAMPLE 3

Part A: A 1,000-gram sample of the same sylvinite ore was treated according to the procedure in Example 1A, except that 0.1 pound each of caprylic acid and a glycol ester defoamer per ton of ore was added as collector. The collector was added as an emulsion containing, by weight, 5.0 percent caprylic acid, 5.0 percent glycol ester defoamer, 0.1 percent sodium cetyl sulfate (emulsifier), and 89.9 percent tap water. A reagent conditioning time of 5 minutes per rougher flotation stage was used. Flotation time required in each rougher step was as follows: 2 minutes for the first rougher step, 3 minutes for the second rougher step, and 4 minutes for the third rougher step.

Part B: Part A was repeated except that the collector mixture consisted of caprylic acid and a polyglycol ester defoamer.

Part C: Part A was repeated, except that the collector mixture consisted of oleic acid and a glycol ester defoamer.

Part D: Part A was repeated, except the collector mixture consisted of oleic acid and a polyglycol ester defoamer. The results of these tests are listed in Table 4.

Table 4

Insol slimes rougher flotation using Betz 1160 flocculant with various fatty acid-defoamer combinations at a natural pulp pH of 7.6

| Part | Collector combination | Assay, wt-pct $K_2O$ | Assay, wt-pct Water Insol | Distribution, pct $K_2O$ | Distribution, pct Water Insol |
|---|---|---|---|---|---|
| A | Caprylic acid-glycol ester | 8.1 | 36.1 | 6.4 | 78.4 |
| B | Caprylic acid-polyglycol ester | 8.2 | 29.9 | 9.3 | 81.4 |
| C | Oleic acid-glycol ester | 7.8 | 34.7 | 7.8 | 80.0 |
| D | Oleic acid-polyglycol ester | 4.4 | 39.6 | 3.9 | 74.2 |

EXAMPLE 4

Part A: One thousand grams of the same sylvinite ore was processed according to the procedure in Example 1A, except that 0.1 pound Betz 1160 flocculant per ton of ore was added prior to each flotation rougher step, along with 0.05 pound each of Diesel Oil No. 2 and a glycol ester defoamer per ton of ore. This reagent was added as an emulsion containing, by weight, 5.0 percent Diesel Oil No. 2, 5.0 percent glycol ester defoamer, 0.1 percent sodium cetyl sulfate, and 89.9 percent tap water. A fourth rougher flotation step was required in which 0.05 pound each of Diesel Oil No. 2 and glycol ester defoamer per ton of ore was added. No additional flocculant was added. A reagent conditioning time of 5 minutes per rougher flotation step was used. Flotation time requirements were as follows: 2 minutes for the first rougher step, 2 minutes for the second rougher step, 5 minutes for the third rougher step, and 4 minutes for the fourth rougher step.

Part B: Part A was repeated, except that the collector dosage was increased to 0.1 pound per ton of ore each, in each rougher flotation step.

Part C: Part B was repeated, except that the flocculant dosage was increased to 0.2 pound per ton of ore in each rougher flotation step (excluding the fourth rougher step).

Part D: Part C was repeated, except that the collector dosage was increased to 0.3 pound per ton of ore each, in each rougher flotation step. The results of these tests are listed in Table 5.

Table 5

Insol slimes rougher flotation using various amounts of Betz 1160 flocculant, Diesel Oil No. 2, and glycol ester defoamer at a natural pulp pH of 7.6

| Part | Reagent dosage (lb/ton) Betz 1160 | Reagent dosage (lb/ton) Diesel oil No.2 | Reagent dosage (lb/ton) Glycol ester | Assay, wt-pct $K_2O$ | Assay, wt-pct Water Insol | Distribution, pct $K_2O$ | Distribution, pct Water Insol |
|---|---|---|---|---|---|---|---|
| A | 0.3 | 0.2 | 0.2 | 7.5 | 34.4 | 5.5 | 61.7 |
| B | 0.3 | 0.4 | 0.4 | 3.8 | 39.4 | 3.6 | 80.4 |

Table 5-continued

Insol slimes rougher flotation using various amounts of Betz 1160 flocculant, Diesel Oil No. 2, and glycol ester defoamer at a natural pulp pH of 7.6

| Part | Reagent dosage (lb/ton) Betz 1160 | Reagent dosage (lb/ton) Diesel oil No.2 | Reagent dosage (lb/ton) Glycol ester | Assay, wt-pct $K_2O$ | Assay, wt-pct Water Insol | Distribution, pct $K_2O$ | Distribution, pct Water Insol |
|---|---|---|---|---|---|---|---|
| C | 0.6 | 0.4 | 0.4 | 8.7 | 26.4 | 12.3 | 85.0 |
| D | 0.6 | 1.2 | 1.2 | 7.2 | 35.6 | 7.6 | 86.0 |

EXAMPLE 5

Part A: A thousand grams of the same sylvinite ore was treated according to the procedure in Example 4A, except that 0.05 pound each of caprylic acid and glycol ester defoamer per ton of ore was employed as collector. The reagents were added as the emulsion described in Example 3A.

Part B: Part A was repeated, except that the collector dosage was increased to 0.1 pound per ton of ore each, in each rougher flotation step.

Part C: Part B was repeated, except that the flocculant dosage was increased to 0.2 pound per ton of ore in each rougher flotation step (excluding the fourth rougher step).

Part D: Part C was repeated, except that the collector dosage was increased to 0.3 pound per ton of ore each, in each rougher flotation step. The results of the tests are listed in Table 6.

Table 6

Insol slimes rougher flotation using various amounts of Betz 1160 flocculant, caprylic acid, and glycol ester defoamer at a natural pulp of 7.6

| Part | Reagent dosage (lb/ton) Betz 1160 | Reagent dosage (lb/ton) Caprylic acid | Reagent dosage (lb/ton) Glycol ester | Assay, wt-pct $K_2O$ | Assay, wt-pct Water Insol | Distribution,pct $K_2O$ | Distribution,pct Water Insol |
|---|---|---|---|---|---|---|---|
| A | 0.3 | 0.2 | 0.2 | 13.5 | 23.2 | 17.3 | 81.0 |
| B | 0.3 | 0.4 | 0.4 | 9.0 | 25.8 | 10.7 | 75.8 |
| C | 0.6 | 0.4 | 0.4 | 8.1 | 36.1 | 6.7 | 78.4 |
| D | 0.6 | 1.2 | 1.2 | 9.6 | 22.2 | 14.2 | 76.4 |

Best results were obtained using emulsions of fatty acids or Diesel Oil No. 2 mixed with glycol or polyglycol esters. Reagent schemes and metallurgical results are listed below in Table 7 and Table 8, respectively.

Table 7

| Reagent Scheme | Reagents, g/metric ton of ore (lb/ton of ore) | |
|---|---|---|
| 1 | 150 (0.30) | cationic flocculant; 150(0.30) fuel oil (nonionic collector) |
| | 150 (0.30) | ethylene glycol monoacetate (glycol ester) |
| 2 | 150 (0.30) | cationic flocculant; 200 (0.40) caprylic acid; (anionic collector) |
| | 200 (0.40) | glycol ester defoamer |
| 3 | 300 (0.60) | cationic flocculant; 200 (0.40) oleic acid; (anionic collector) |
| | 200 (0.40) | polyglycol ester defoamer |

Table 8

| Reagent scheme | Product | Assay,wt-pct $K_2O$ | Assay,wt-pct Water Insol | Distribution, pct $K_2O$ | Distribution, pct Water Insol |
|---|---|---|---|---|---|
| 1 | Insol rougher concentrate | 3.5 | 43.1 | 4.0 | 82.2 |
| | Potash rougher concentrate | 56.9 | 1.8 | 87.4 | 4.6 |
| | Tailings | 1.3 | 1.3 | 8.6 | 13.2 |
| 2 | Insol rougher concentrate | 4.2 | 30.3 | 6.5 | 82.2 |
| | Potash rougher concentrate | 53.8 | 1.9 | 88.3 | 5.6 |

Table 8-continued

| Reagent scheme | Product | Assay, wt-pct $K_2O$ | Assay, wt-pct Water Insol | Distribution, pct $K_2O$ | Distribution, pct Water Insol |
|---|---|---|---|---|---|
| | Tailings | .7 | 1.0 | 5.2 | 12.2 |
| 3 | Insol rougher concentrate | 4.4 | 39.6 | 3.9 | 74.2 |
| | Potash rougher concentrate | 48.7 | 3.0 | 86.2 | 11.1 |
| | Tailings | 1.6 | 1.2 | 9.9 | 14.7 |

All data presented in this report are corrected for brine entrainment. Reagent schemes 1 and 2, consisting of Diesel Oil No. 2-EGM emulsion and caprylic acid-glycol ester emulsion, respectively, were the most effective and removed 82% of the insol slimes. Subsequent potash rougher flotation recoveries were 87–88%. The low potash concentrate assays, which ranged to 48–57% $K_2O$, were attributed to mechanically entrained fine halite and reagentized insol slimes that floated with the potash.

Cleaner flotation steps were performed on rougher concentrates produced by reagent scheme 2. Results show that direct cleaner flotation upgraded the rougher concentrate from 54% to 59% $K_2O$ at a reduced recovery of 82%. Desliming of the rougher concentrate followed by cleaner flotation upgraded the product to 60% $K_2O$. Overall recoveries ranged from 78–82%.

A comparison of insol slimes flotation schemes was effected. Insol slimes flotation using a nonionic flocculant-cationic surfactant reagent scheme was compared with the invention reagent scheme comprising cationic flocculant-caprylic acid-glycol ester defoamer. Results indicate that the reagent scheme of the invention renders residual insols, not removed by flotation, inert during subsequent potash rougher flotation.

EXAMPLE 6

Part A: One thousand grams of the same sylvinite ore was treated according to the procedure in Example 1A, except that Superfloc 127, a high molecular weight nonionic polyacrylamide flocculant, and Aero Promoter 870, a cationic surfactant supplied by American Cyanamid Co., were added to each of the three rougher steps at dosages of 0.1 pound each per ton of ore. A dosage of 0.05 pound each of Superfloc 127 and Aero Promoter 870 per ton of ore was added to a fourth rougher step. Total insol slimes flotation time was 9 minutes. After the final insol slimes rougher flotation step, conventional KCl flotation was performed in the following manner: guar gum at a dosage of 0.3 pound per ton of ore was added to the deslimed pulp as a slime blinder and conditioned for 2 minutes at 1,600 rpm. After this conditioning step, 0.075 pound of emulsified flotation oil and 0.225 pounds of primary aliphatic amine chloride per ton of ore were added to the pulp and conditioned 2 minutes at 1,600 rpm. A drop of frother was then added, air was introduced into the cell and a froth product skimmed for 2 minutes until the froth was no longer mineralized.

Part B: Part A was repeated, except that a fifth insol rougher was made employing 0.05 pound each of Superfloc 127 and Aero Promoter 870 per ton of ore. Total insol slimes flotation time was 6 minutes.

Part C: Part A was repeated with only 3 insol slimes rougher flotation steps, using 0.1 pound each of Superfloc 127 and Aero Promoter 870 per ton of ore in each rougher step. Total insol slimes rougher flotation time was 8 minutes.

Part D: Part A was repeated using 0.05 pound each of Superfloc 127 and Aero Promotor 870 per ton of ore in the first 3 insol slimes rougher flotation steps, and 0.05 pound each per ton of ore in the fourth insol slimes rougher step. Five minutes total insol slimes rougher flotation time was required.

Part E: Part A was repeated, except that 0.2 pound Betz 1160 flocculant per ton of ore and 0.1 pound each of caprylic acid and a glycol ester defoamer per ton of ore were used to float insol slimes in each of 3 rougher flotation steps after 5 minutes conditioning. A total flotation time of 6 minutes was required.

Part F: Part E was repeated, except that 0.1 pound each of caprylic acid and glycol ester defoamer per ton of ore were used in the first and second insol slimes rougher flotation steps. These collectors were added as an emulsion described in Example 5A. A dosage of 0.2 pound each of caprylic acid and glycol ester defoamer per ton of ore was used in a third insol slimes rougher flotation step. Total insol slimes rougher flotation time was 13 minutes.

Part G: Part F was repeated using the oleic acid-polyglycol ester defoamer emulsion described in Example 3C. A total insol slimes rougher flotation time of 7 minutes was required. The results of these tests are listed in Table 9.

Table 9

Insol slimes rougher flotation and subsequent KCl rougher flotation using a nonionic flocculant-cationic surfactant reagent scheme and a cationic flocculant-fatty acid-defoamer reagent scheme (pH = 7.6)

| Part | Reagent scheme | Insol slimes removed, pct | Subsequent KCl flotation recovery, pct |
|---|---|---|---|
| A | Nonionic flocculant-cationic surfactant | 85.2 | 84.8 |
| B | Nonionic flocculant-cationic surfactant | 81.7 | 82.6 |
| C | Nonionic flocculant-cationic surfactant | 77.6 | 76.3 |
| D | Nonionic flocculant-cationic surfactant | 78.2 | 64.7 |
| E | Cationic flocculant-fatty acid-defoamer | 79.7 | 86.3 |
| F | Cationic flocculant-fatty acid-defoamer | 78.4 | 86.7 |
| G | Cationic flocculant-fatty acid-defoamer | 74.2 | 86.2 |

Figure 3:
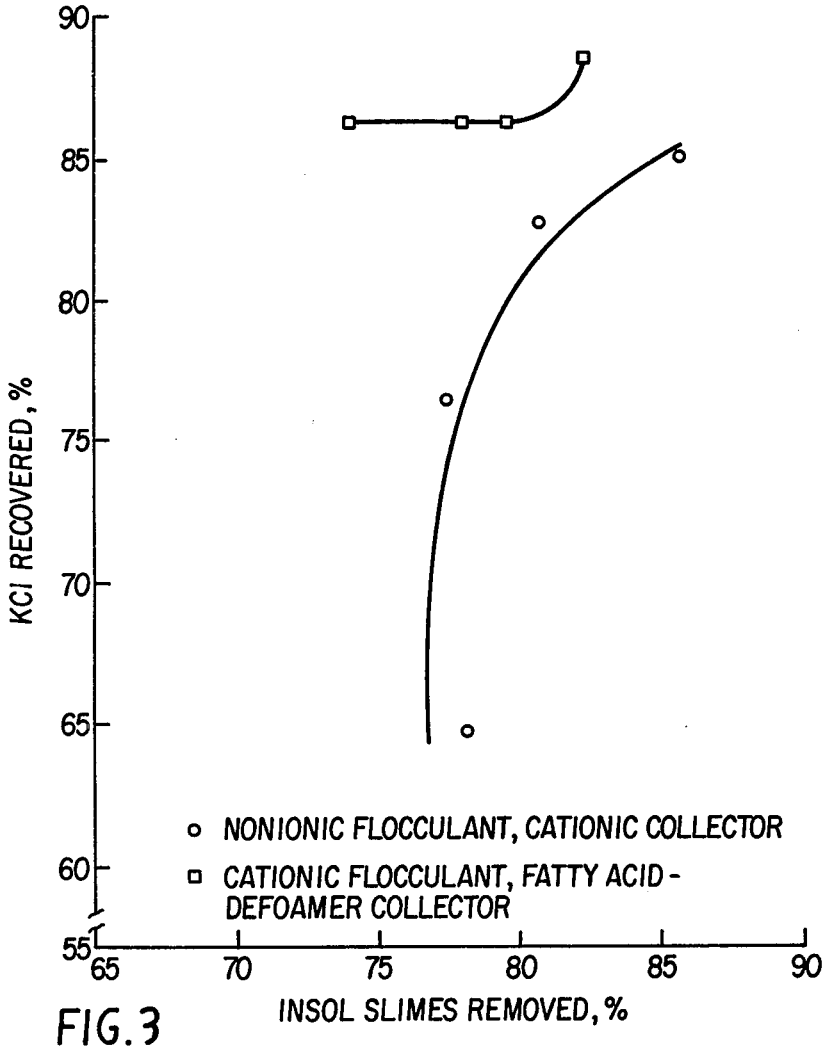
FIG. 3 is a graph representing insoluble slimes removed in percent as a function of KCl recovered in percent at natural pulp pH under nonionic flocculant with cationic collector and cationic flocculant with fatty acid-defoamer collector conditions.

The results of the tests conducted in Example 6 are graphically represented in FIG. 3 which shows $K_2O$ recovery in the potash rougher as a function of insol recovery in the insol rougher using both insol rougher flotation reagent schemes.

EXAMPLE 7

One thousand grams of the same sylvinite ore was pulped at 30 percent solids in a Fagergren flotation cell with a saturated equilibrium brine. The slurry was scrubbed for 15 minutes in the cell at 1,600 rpm (827 feet per minute peripheral impeller speed), after which time the slurry was transferred to a four liter beaker and stirred gently with a spatula for 1 minute. The slurry was allowed to settle for 15 seconds, after which time the suspended slimes were decanted onto a 150-mesh screen. After decanting, the material remaining on the screen was washed back into the deslimed ore, which was repulped to 30 percent solids with saturated equilibrium brine. The slurry was then deslimed again by the decantation procedure described above. After washing the material remaining on the screen back into the deslimed ore, conventional KCl flotation was performed as outlined in Example 6A. The results of this test are compared with the results of Example 6F in Table 10.

Table 10

Comparison of insol slimes removal methods using 2-stage decantation desliming, and flotation with a cationic flocculant-fatty acid-defoamer reagent scheme at pH 7.6

| Method | Tons of brine required per ton of ore | Insol slimes removed, pct | Subsequent KCl flotation recovery, pct |
|---|---|---|---|
| 2-stage mechanical desliming | 7.8 | 89.0 | 75.7 |
| Cationic flocculant-fatty acid-defoamer flotation | 4.9 | 78.4 | 86.7 |

The difference in sensitivity of the potash rougher to residual insol slimes is striking. Using a nonionic flocculant-cationic surfactant reagent scheme for insol slimes flotation, subsequent potash rougher flotation recovery decreased drastically, from 85% at 85% insol slimes removal to 65% at 77% insol slimes removal. When a cationic flocculant-caprylic acid-defoamer reagent scheme was used to float insol slimes, subsequent potash recovery remained constant at 86% as insol slimes removal decreased from 80–74%. A synergistic effect between the insol slime blinder and the residual fatty acid in the flotation brine may be responsible for this phenomenon.

The use of a cationic flocculant-caprylic acid-glycol ester reagent scheme for insol slimes flotation, combined with desliming the subsequent potash rougher, allows for a considerable flexibility in insol slimes flotation performance. This flexibility is an important consideration in flowsheet development, because consistently high potash recovery may be maintained even when insol slimes flotation recovery is poor.

A comparison of mechanical desliming with insol slimes flotation was made through performing two-stage mechanical desliming tests which were then compared with insol slimes flotation procedures. The flotation techniques used either the nonionic flocculant-cationic surfactant reagent scheme or the reagent scheme of the invention comprising cationic flocculant caprylic acid-glycol ester.

The nonionic flocculant-cationic surfactant reagent scheme required 175 grams per ton (0.35 pound per ton) of each reagent. Flotation desliming using the cationic flocculant-caprylic acid-glycol ester reagent scheme required 150 grams per ton (0.3 pound per ton) of flocculant and 200 grams per ton (0.4 pound per ton) each of caprylic acid and glycol ester. Test results, shown in following Table 11, indicated 89% insol slimes removal using mechanical desliming, compared with 82% to 85% removal using flotation desliming.

Table 11

Mechanical and flotation desliming of potash ores

| Deslime Method | Product | Assay, wt-pct $K_2O$ | Assay, wt-pct Water Insol | Distribution, pct $K_2O$ | Distribution, pct Water Insol |
|---|---|---|---|---|---|
| Mechanical | Insol product | 4.2 | 23.2 | 10.7 | 89.0 |
| | Potash rougher concentrate | 54.9 | 1.4 | 75.7 | 2.9 |
| | Tailings | 1.7 | .7 | 13.6 | 8.1 |
| Flotation (Nonionic flocculant Cationic surfactant) | Insol rougher concentrate | 2.7 | 26.5 | 3.9 | 85.2 |
| | Potash rougher concentrate | 56.8 | 1.2 | 84.8 | 4.0 |
| | Tailings | 1.8 | .8 | 11.3 | 10.8 |
| Flotation (Invention Scheme) | Insol rougher concentrate | 4.2 | 30.3 | 6.5 | 82.2 |
| | Potash rougher concentrate | 53.8 | 1.9 | 88.3 | 5.6 |
| | Tailings | .7 | 1.0 | 5.2 | 12.2 |

However, potash losses to the slimes product were greater with mechanical desliming. Almost 11% of the potash in the ore reported to the deslime product, compared with 4% to 7% potash losses to the insol slimes concentrate when using flotation desliming. Potash recovery in the subsequent potash rougher flotation was only 76% after mechanical desliming, compared with 85% to 88% recovery after flotation desliming. These batch tests also indicated that mechanical desliming required larger volumes of process brine than flotation desliming.

The advantages of using insol slimes flotation to remove slimes include lower potash losses in the deslime product, lower brine requirements, and improved potash recoveries in subsequent potash flotation.

A comparison was made of the filtration rate of insol slimes concentrates. Batch top-loading filtration tests were performed on both insol slimes flotation concentrates and mechanical deslimed flocculated insol slimes. A standard 0.009 square meter (0.1 square foot) filter leaf with a 7.6 centimeter (3 inch) collar was used. Test results indicated an extremely slow filtration rate of 0.01 meter per minute per square meter of filter (0.03 gallon per minute per square foot of filter) for a mechanically deslimed product compared with 0.07 meter per minute per square meter of filter (0.21 gallon per minute per square foot of filter) for flotation concentrate. Brine recovery for both insol slimes products ranged from 88–91%.

Figure 4:
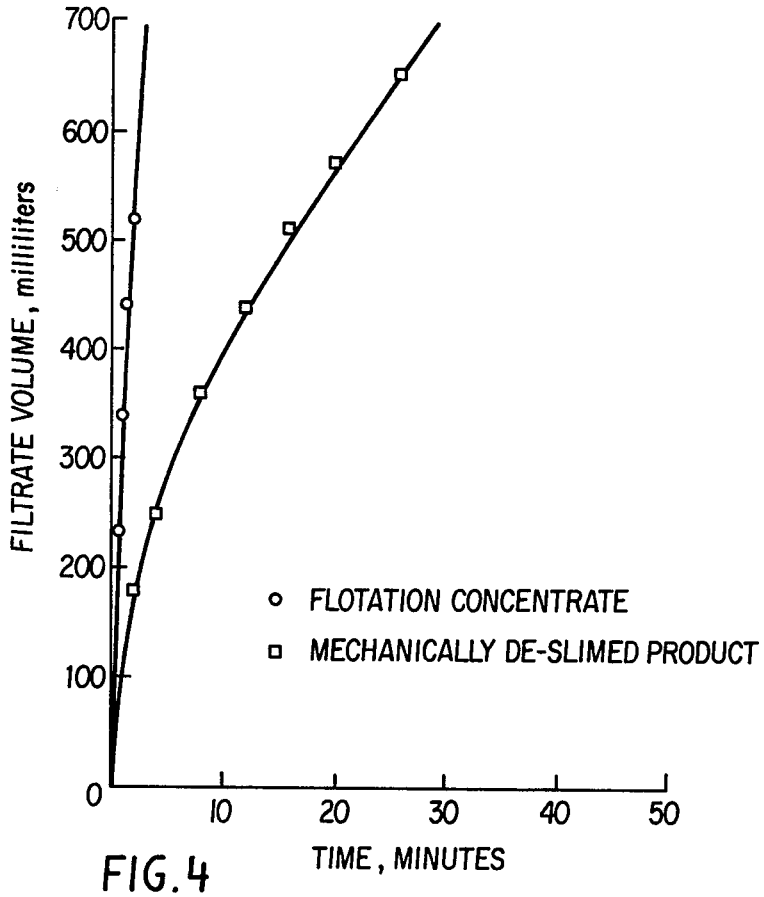
FIG. 4 is a graph representing the filterability of various water insoluble slimes products in terms of time in minutes as a function of filtrate volume in milliliters for both a flotation concentrate and a mechanically deslimed product.

The insol slimes concentrate slurries were dilute, ranging from 6–8% solids. Filtration was therefore investigated as a method of recovering the large amounts of brine entrained in these concentrates. Comparison of an insol slimes flotation concentrate with a flocculated, mechanically deslimed product using the Buchner funnel apparatus is graphically presented in FIG. 4. The marked increase in the filtration rate observed for the flotation concentrate was due to entrained air in the floated floccules producing a permeable filter cake.

For subsequent potash flotation, the deslimed pulp was diluted to 23% solids pulp density in a Fagergren laboratory flotation cell. The pulp was conditioned for two minutes with 150 grams per ton (0.3 pound per ton) of insol slime blinder and for two additional minutes with 40 and 115 grams per ton (0.8 and 0.23 pound per ton) of flotation oil and amine chloride, respectively. After conditioning, a drop of frother was added and a potash flotation rougher concentrate was collected for two minutes at a peripheral impeller speed of 4.72 meters per second (930 feet per minute). Potash rougher concentrates from two tests were combined in a 500 gram Denver laboratory flotation cell to provide enough material for a cleaner flotation. The combined pulp was conditioned for two minutes at 23% solids pulp density with 150 grams per ton (0.30 pound per ton) of insol slime blinder, and for two additional minutes with 25 and 15 grams per ton (0.05 and 0.03 pound per ton) of amine chloride and flotation oil, respectively. Cleaner flotation lasted two minutes.

Bench-scale investigations have shown that flotation is an effective means of removing insol slimes from lower grade potash ore containing high contrations of water insolubles. From 82% to 85% insol slimes removal was obtained while using the reagent schemes of the invention. Subsequent potash rougher flotation recovered over 85% of the potash. Moreover, potash rougher flotation following desliming was less sensitive to residual slimes concentration when the reagent scheme of the invention was used to float insoluble slimes. When using a nonionic flocculant-cationic surfactant collector reagent scheme, at least 85% insol slimes removal was found to be necessary in order to obtain an 85% potash recovery. By contrast, only 74% insol slimes removal was necessary when utilizing the reagent scheme of the prevent invention in order to obtain a similar potash recovery.

What is claimed is:

1. A froth flotation process for removing insoluble slimes from sylvinite ore in a saturated brine pulp prior to potash flotation, comprising utilizing as the froth flotation collector a mixture of distilled fuel oil and a defoamer consisting essentially of ethylene glycol monoacetate and floating off said insoluble slimes.

2. The process of claim 1 wherein the froth flotation collector is utilized in an amount sufficient to render any residual insoluble slimes inert during the subsequent potash flotation.

3. The process of claim 1 wherein the insoluble slimes are subjected to selective flocculation prior to the removal thereof through froth flotation.

4. The process of claim 3 wherein the insoluble slimes are flocculated with an acrylamide polymer.

5. The process of claim 4 wherein the acrylamide polymer is selected from the group consisting of a nonionic polyacrylamide, a cationic acrylamide copolymer, and mixtures thereof.

* * * * *